US006960997B2

(12) United States Patent
Gieseke et al.

(10) Patent No.: US 6,960,997 B2
(45) Date of Patent: Nov. 1, 2005

(54) METHOD FOR TRANSMITTING LOCATION-RELATED DATA BETWEEN A MAIN STATION AND A MOBILE TERMINAL, MOBILE TERMINAL AND MAIN STATION

(75) Inventors: Arnold Gieseke, Giesen (DE); Martin Hans, Hildesheim (DE); Gunnar Schmidt, Wolfenbuettel (DE); Dieter Thoms, Hildesheim (DE); Frieder Mundt, Neumuenster (DE)

(73) Assignee: Robert Bosch GmbH, Stuttgart (DE)

( * ) Notice: Subject to any disclaimer, the term of this patent is extended or adjusted under 35 U.S.C. 154(b) by 135 days.

(21) Appl. No.: 10/220,116

(22) PCT Filed: Feb. 16, 2001

(86) PCT No.: PCT/DE01/00593

§ 371 (c)(1),
(2), (4) Date: Jan. 6, 2003

(87) PCT Pub. No.: WO01/65522

PCT Pub. Date: Sep. 7, 2001

(65) Prior Publication Data

US 2003/0164779 A1 Sep. 4, 2003

(30) Foreign Application Priority Data

Mar. 3, 2000 (DE) ..... 100 10 436

(51) Int. Cl.[7] ..... G08B 1/08; G08G 1/123

(52) U.S. Cl. ..... 340/539.13; 340/990; 340/995.1; 340/995.12; 340/995.14; 340/995.15; 340/995.19; 701/208

(58) Field of Search ..... 340/539.13, 825.36, 340/825.49, 988, 989, 990, 995.1, 995.11, 995.12, 995.13, 995.14, 995.15, 995.17, 995.19, 526; 701/117–119, 208–211, 212

(56) References Cited

U.S. PATENT DOCUMENTS 5,699,255 A * 12/1997 Ellis et al. ..... 701/212
6,061,003 A * 5/2000 Harada ..... 340/995.15
6,330,453 B1 * 12/2001 Suzuki et al. ..... 455/457

FOREIGN PATENT DOCUMENTS

| | | |
|---|---|---|
| EP | 0 379 198 | 7/1990 |
| EP | 0 875 878 | 11/1998 |
| GB | 2 195 868 | 4/1988 |
| JP | 9-325040 | 12/1997 |
| JP | 11-295084 | 10/1999 |
| WO | WO 99 27323 | 6/1999 |
| WO | WO 01 01370 | 1/2001 |
| WO | WO 01 28270 | 4/2001 |

OTHER PUBLICATIONS

Patent Abstracts of Japan vol. 1996, No. 02, Feb. 29, 1996 & JP 07 262493 A (CSK CORP), Oct. 13, 1995 Abstract*.
Patent Abstracts of Japan vol. 1996, No. 08, Aug. 30, 1996 & JP 08 095488 A (Ekushingu:KK;Brother Ind Ltd), Apr. 12, 1996 Abtract*.
Patent Abstracts of Japan vol. 1998, No. 04, Mar. 31, 1998 & JP 09 319300 A (Seiko Epson Corp) Dec. 12, 1997 Abstract*.

* cited by examiner

*Primary Examiner*—Donnie L. Crosland
(74) *Attorney, Agent, or Firm*—Kenyon & Kenyon

(57) ABSTRACT

A method for transmitting location-related data information between a main station and a mobile terminal is described, as well as a main station and a mobile terminal are described, which provide a position tracing of the mobile terminal or a navigational application on the display device of the mobile terminal. The mobile terminal may include a mobile telecommunications terminal. In a first step, a position of a mobile terminal is ascertained and transmitted to the main station. In a second step, location-related data information for the mobile terminal is formed in the main station, in dependence upon the ascertained position of the mobile terminal. In a third step, the location-related data information is transmitted from the main station to the mobile terminal. In a fourth step, the location-related data information received is brought to reproduction on a reproduction device of the mobile terminal.

30 Claims, 3 Drawing Sheets

METHOD FOR TRANSMITTING LOCATION-RELATED DATA BETWEEN A MAIN STATION AND A MOBILE TERMINAL, MOBILE TERMINAL AND MAIN STATION

FIELD OF THE INVENTION

The present invention relates to a method for transmission of location-related data between a main station and a mobile terminal, by a mobile terminal and by a main station.

BACKGROUND INFORMATION

Conventional methods for transmitting location-related data between a main station and a mobile terminal may be used, for example, in locating mobile radio devices in a cellular mobile radio network.

With the aid of GPS (Global Positioning System) technology, a location may be determined to an accuracy of 10 m. This system may be used, for instance, in determining the location of ships and motor vehicles, such as with the"Travel Pilot" of Blaupunkt. In this respect, location information may be entered into local existing map material which may be present on a data carrier, such as a compact disk, and may be presented visually to the user. The location information may be used, for instance, for calculating the route and for guiding the user to a desired destination.

The H.32x methods standardized by the ITU-T (International Telecommunication Union) may be used for transmitting audio, video and data information over fixed and mobile networks. In this connection, the main field of use is videotelephony between two or more terminals. In the most recent period, these standards may be increasingly used for transmitting multimedia information such as live-camera pictures or for TV transmission, such as via the TV Infoserver of German Telekom.

Currently obtainable mobile telephones, such as the Nokia mobile telephone, and PDA's (Personal Digital Assistant), such as the Apple Message Pad may, have sufficiently large displays to show map material. On account of the limited memory being offered in the named terminals, mobile telephones may currently be used only as voice terminals, as an interface for access to the Internet and for sending text messages, for example, e-mail on the Internet or short messages according to the SMS Standard (Short Message Service).

SUMMARY OF THE INVENTION

An example method according to the present invention for transmitting location-related data information, a mobile terminal according to an example embodiment of the present invention and a main station according to an example embodiment of the present information, may provide that, in a first step, a position of a mobile terminal may be ascertained and transmitted to the main station, that, in a second step, location-related data information for the mobile terminal may be formed in the main station in dependence upon the ascertained position of the mobile terminal, that, in a third step, the location-related data information may be transmitted from the main station to the mobile terminal, and that, in a fourth step, the location-related data information may be brought to reproduction on a reproduction device of the mobile terminal. In this manner, the location-related data information, such as, for instance, the determination of the location of the mobile terminal may be implemented, with the aid of a geographical map or a route recommendation for a navigational application, independently of the memory space and computing capacity available in the mobile terminal, so that the functionality and the usefulness of the mobile terminal may be increased, such as, for example, if configured as a mobile telephone or PDA.

It may be provided that, in the second step, a section of a geographical map may be selected in the main station which includes the ascertained position of the mobile terminal, that, in a third step, the selected map section may be transmitted from the main station to the mobile terminal and that, in a fourth step, the transmitted map section having the ascertained position may be brought to reproduction on a reproduction device.

In this manner, the map material may be centrally retained in the main station, for instance, in a navigation server, and there may be rapidly and simply updated. An updating performed in the main station may be useful to many users of correponding mobile terminals. On account of the central storage, storage space in the terminals may be saved, and multiple storage of map material may be prevented.

It may be provided that a destination is entered in the mobile terminal and transmitted to the main station, that a route proposal between the ascertained position of the mobile terminal and the destination input is computed in the main station, that the route proposal is transmitted by the main station to the mobile terminal as additional information, and that the route proposal is reproduced on the reproduction device of the mobile terminal. In this manner, the terminal may be used for navigation and route guidance, which may enhance its functionality. In this context, if the mobile terminal is configured as a mobile telephone or as a PDA, it may become a navigational device which may also be used by pedestrians and bicyclists.

It may also be provided that the selected map section is transmitted to the mobile terminal in coded form, by a compression method, particularly by using one of image compression methods H.261 and H.263 according to ITU-T Standard H.32x (International Telecommunication Union). In this manner, bandwidth may be saved in the transmission of the map section from the main station to the mobile terminal, so that the transmission of the map material from the main station to the mobile terminal may be implementable even with limited bandwidth of a mobile radio network used as transmission medium.

It may also be provided that, in a fifth step, a new position of the mobile terminal may be ascertained and transmitted to the main station, that, in a sixth step, a new map section may be selected in the main station, which may include the new position of the mobile terminal, that, in a seventh step, image data may be transmitted from the main station to the mobile terminal, in dependence upon the differences between the selected new map section and the present map section, and that, in an eighth step, the present map section may be brought updated to reproduction on the reproduction device of the mobile terminal, in dependence upon the transmitted image data. When done in this manner, it may not be required, when updating the map section brought to reproduction on the reproduction device of the mobile terminal, each time to transmit a completely new map section from the main station to the mobile terminal, but only the changes between the image data shown in the present map section and the new map section. When the new map section includes a part of the present map section, this example method may lead to a transmission, requiring little bandwidth, of the image data required for updating the present map section. Such an updating may then be also performed particularly fast.

Such a bandwidth-saving method for the transmission of image data, from the main station to the mobile terminal, which data are then used for updating the map section reproduced on the reproduction device of the mobile terminal, may be implemented in that, at the selection of the new map section in the sixth step, e.g. when using one of image compression methods H.261 and H.263, the present map section may he divided up into individual image blocks, that for each of the image blocks, a movement vector may be calculated in dependence upon the position change from the previous position to the new position of the mobile terminal, that the new map section may be estimated starting from the present map section and the movement vectors, that the estimated map section may be compared to the new map section by difference formation, so that a difference image may be created, that, using the image data in the seventh step, the difference image may be transmitted to the mobile terminal, that, in a seventh step, the movement vectors may also be transmitted from the main station to the mobile terminal, and that, in the eighth step, the map section to be reproduced on the reproduction device may be computed from the present map section, in that the present map section may be shifted block-wise with the aid of the movement vectors, and the shifted map section formed in this manner may be overlaid with the difference image. In this context, the transmission of the difference image and of the movement vectors may require less bandwidth and may be more rapid than the transmission of the complete new map section from the main station to the mobile terminal. It may be also the case that, for transmitting image data, a method already used in videotelephony may be used, for instance, a standardized H.32x method, so that the application range of such an example method may become greater, and no new method may be required for the transmission of map materials.

It may also be provided that, at predefined times in the seventh step, the new map section may be transmitted from the main station to the mobile terminal with the aid of the image data, and that, in the eighth step, the new map section may be brought to reproduction on the reproduction device in the new position. In this manner it may be possible, at regular intervals, to adjust the reproduction of the map material at the mobile terminal to the original map material, and thereby to limit an accumulation of transmission errors in the transmission of the difference image and of the movement vectors, which may lead to a corruption of the map material to be reproduced.

It may be provided that, during selection of the new map section in the sixth step, map regions may be ascertained which may be included only in the new map section and not in the present map section, that, in the seventh step, the ascertained map regions may be transmitted from the main station to the mobile terminal with the aid of the image data, and that, in the eighth step, the map section to be reproduced on the reproduction device may be calculated from the presently reproduced map section in that the present reproduced map section may be shifted on account of the overall movement vector computed from the position change of the previous position to the new position of the mobile terminal, and the shifted map section formed in this manner may be supplemented by the transmitted map sections. In this manner, bandwidth may also be saved in the transmission of the image data from the main station to the mobile terminal, required for updating the map section reproduced currently on the reproduction device, since only the changing map regions may have to be transmitted from the main station to the mobile terminal. Map regions which are included in both the present and the new map sections may not have to be transmitted Therefore, the transmission of the image data required for updating the map sections reproduced on the reproduction device may also occur rapidly, and it may become more rapid the less the new map region deviates from the present map section, since then fewer supplementing map regions may have to be transmitted from the main station to the mobile terminal. By the transmission of original map regions from the main station to the mobile terminal one may avoid accumulation of transmission errors as may occur, for example during successive transmission of difference images. Regular transmission of a complete new map section for limiting such accumulating errors may not therefore be required. Furthermore, no computation of a difference image and no estimation of the new map section in the main station may be required, so that, compared to the previously described method, computing effort and computing time may be saved in the main station. The updating of the map section to be reproduced on the reproduction device of the mobile terminal may therefore occur that much more quickly.

The image data to be transmitted for the updating of the map sections to be reproduced on the reproduction device of the mobile terminal may also be transmitted in a desirable manner by a compression method, e.g. using one of the image compression methods H.261 and H.263 according to ITU-T Standard H.32x, while saving bandwidth and transmission time.

It may also be provided that, in the first step, information about the size of the map section that may be shown on the display device is transmitted from the mobile terminal to the main station. In this manner, the size of the map section transmitted from the main station to the mobile terminal, the size of the difference image or the size of the supplementary map regions to be transmitted for updating the map section to be reproduced may already be adapted in the main station to the size of the map section to be reproduced on the reproduction device. This may prevent the transmission of too many image data, and therefore an excessive demand for bandwidth and transmission time.

It may also be provided that the position of the mobile terminal is input on an input device of the mobile terminal. In this manner, the user of the mobile terminal may input any position whatever, and thereby request return from the main station of any map sections whatsoever.

DETAILED DESCRIPTION

Figure 1:
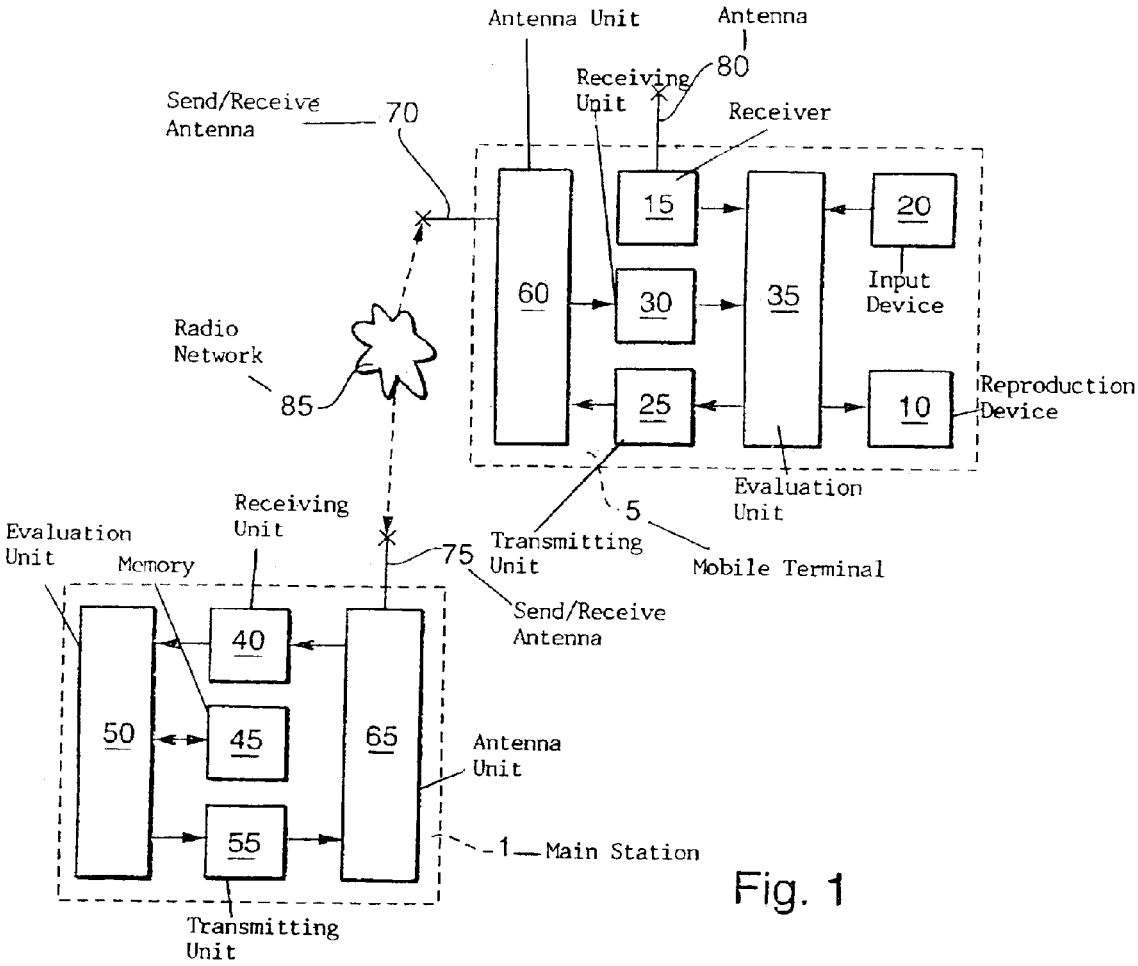
FIG. 1 is a block diagram of a main station according to an example embodiment of the present invention and a mobile terminal for performing an example method according to the present invention for transmitting location-related data information.

In FIG. 1, 5 denotes a mobile terminal which may, for instance, be developed as a mobile phone or as a PDA (Personal Digital Assistant). Mobile terminal 5 includes a first send/receive antenna 70 connected to a first antenna unit 60. First send/receive antenna 70 is here used for sending and receiving data over a mobile radio network 85. First antenna unit 60, in the receiving direction, is connected to a first evaluation unit 35 via a first receiving unit 30. First evaluation unit 35, in the sending direction, is connected to first antenna unit 60 via a first transmitting unit 25. A position-finding receiver 15 is also connected to evaluation unit 35, and may be configured, for example, as a GPS receiver (Global Positioning System), and to which a receiving antenna 80 is connected to receive location-finding data. This receiving antenna 80 for location-finding data may, for instance, designed as a GPS patch antenna. In this example, an input device 20 and a reproduction device 10 are also connected to first evaluation unit 35. Reproduction device 10 here includes a display device, for instance, in the form of a liquid crystal display, and, in addition, may optionally include one or more loudspeakers for acoustical reproduction.

Mobile terminal 5 exchanges location-related data information, via mobile radio network 85, with a main station 1, which includes a second send/receive antenna 75 connected to a second antenna unit 65. In this context, second antenna unit 65 is connected to a second evaluation unit 50 in the receiving path, via a second receiving unit 40. Second evaluation unit 50 is connected in the sending path to second antenna unit 65, via a second transmitting unit 50. Main station 1 also includes a memory 45, which is connected to second evaluation unit 50.

Figure 2:
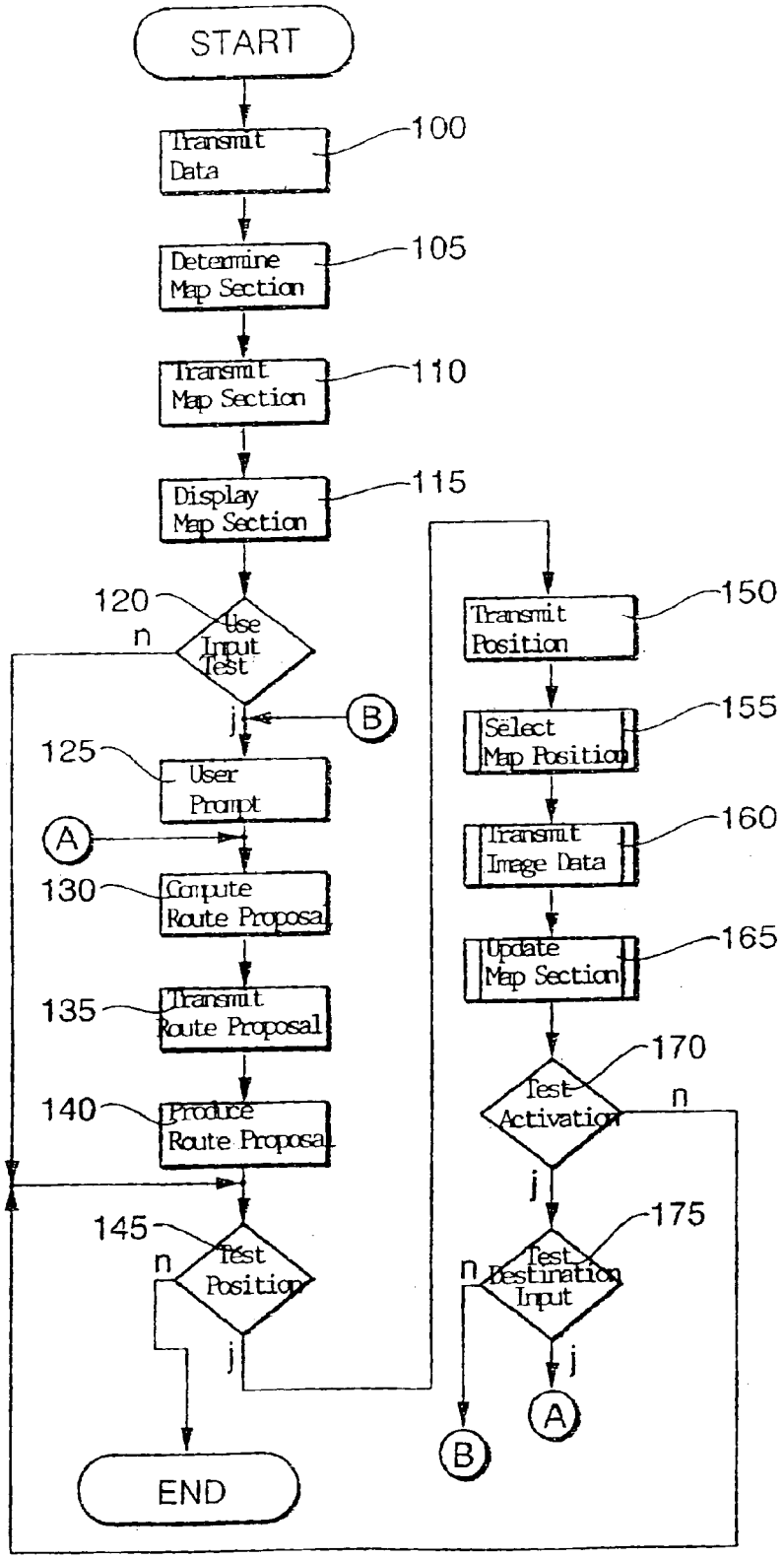
FIG. 2 is a flow diagram for describing a general flow of an example method according to the present invention.

An example method according to the invention is explained in greater detail, using the flow diagram in FIG. 2. At a program point 100, first evaluation unit 35 ascertains a position of mobile terminal 5. The ascertainment of the position may be made, for example, in two different example methods. According to a first example method, the position of mobile terminal 5 is ascertained by receiving location-finding data via receiving antenna 80 for location-finding data and by location-finding receiver 15 in first evaluation unit 35. According to a second example method, it may optionally be provided that the user of mobile terminal 5 inputs any particular position on input device 20, in order to have a look at any particular map section. Subsequently, first evaluation unit 35 causes first transmitting unit 25 to broadcast the position of mobile terminal 5 ascertained in one of the manners mentioned, with the aid of a corresponding location data signal from first send/receive antenna 70 via mobile radio network 85 to main station 1. In this connection, the location data signal may be developed as a text message or a short message, which is transmitted, for instance, in a GSM mobile radio network (Global System for Mobile Communications) as an SMS message (Short Message Service). Using the text message or the short message, a calling number of mobile terminal 5 may also be transmitted to main office 1, so as to make possible a return call from main station 1 for sending map data and/or route suggestions to mobile terminal 5. In main station 1 this location signal having information about the position of mobile terminal 5 is received by second send/receive antenna 75, and passed onto second evaluation unit 50 via second receiving unit 40. Subsequently, the program branches to a program point 105.

At program point 105, second evaluation unit 50 ascertains a section of a geographic map filed in memory 45, this section including the ascertained position of mobile terminal 5. The size of the selected section may here be adapted to the size of the display device of mobile terminal 5. For this, however, main station 1 may be required to know the size of the display device of mobile terminal 5. Corresponding data concerning the size of the display unit of mobile terminal 5 may in this case be transmitted ahead of time or transmitted together with the first ascertained position of mobile terminal 5 to main station 1 at program point 100. Second evaluation unit 50 may additionally select the map section in such a manner that the ascertained position of mobile terminal 5 lies in the middle or in an average range of the selected map section. Of course, it may also be provided that second evaluation unit 50 selects the map section in such a manner that the ascertained position of mobile terminal 5 lies in an edge region of the selected map section. This may make sense with respect to a navigational application if as much as possible of the map material in the direction of planned movement of mobile terminal 5 is to be shown on the display device, but as little as possible of the map material in the region of the path already traveled by mobile terminal 5.

In addition, second evaluation unit 50 fades the ascertained position of mobile terminal 5 into the selected map section, at the appropriate location.

After program point 105 the program branches to a program point 110. At program point 110, second evaluation unit 50 causes second transmitting unit 55, for example, with the aid of a callback because of the received call number of mobile terminal 5, to transmit the selected map section having the faded-in position of mobile terminal 5, with the aid of a suitable image signal, from second send/receive antenna 75 to 5 mobile terminal 5 via mobile radio network 85. This image signal is then received by first send/receive antenna 70 and fed via first receiving unit 30 to first evaluation unit 35. Subsequently, the program branches to a program point 115.

At program point 115, first evaluation unit 35 causes a display of the received map section having the faded-in position of mobile terminal 5 on the display device of reproduction device 10. For the transmission of the selected map section from main station 1 to mobile terminal 5, second evaluation unit 50 may cause a coding of the selected map section by a compression method, in order to save bandwidth and time in transmitting the selected map section from main station 1 to mobile terminal 5. In this connection, transmission of the selected map section may occur, for example, according to the ITU-T Standard H.32x (International Telecommunication Union), one of image compression methods H.261 and H.263 may be used as the method of compression.

At program point 120, first evaluation unit 35 tests whether the user of mobile terminal 5 has input a navigational instruction at input 20. If this is the case, the program branches to a program point 125, otherwise it branches to a program point 145.

At program point 125, first evaluation unit 35 prompts the user, optically or acoustically, via reproduction device 10 to input a destination. After input of the destination on input device 20, first evaluation device 35 causes first transmitting unit 25 to transmit this destination, with the aid of a suitable location data signal, from first send/receive antenna 70 to main station 1 via mobile radio network 85. This location data information is then received via second send/receive antenna 75 in main station 1, and passed on via second receiving unit 40 to second evaluation unit 50. Subsequently, the program branches to a program point 130.

At program point 130, second evaluation unit 50 computes a route proposal between the ascertained position of terminal 5 and the input destination. This route proposal may take into account up-to-date traffic data, such as traffic jams, blockages and changes in the traffic route network, or the like. Subsequently, the program branches to a program step 135.

At program step 135, second evaluation unit 50 causes second transmitting unit 55 to transmit the computed route proposal, with the aid of an appropriate navigational data signal, from second send/receive antenna 75 to mobile terminal 5 via mobile radio network 85. The navigational data signal may also be formed as a text message or a short message, and may, for example, be transmitted in a GSM mobile radio network as an SMS message. The navigational data signal may be transmitted in voice form during a call of mobile terminal 5 by main station 1 is also possible. This navigational data signal is received by first send/receive antenna 70 and fed to first evaluation unit 35 via first transmitting unit 30. Subsequently, the program branches to a program point 140.

At program point 140, first evaluation unit 35 causes an optical and/or acoustical reproduction in reproduction device 10, of the route proposal computed in main station 1. An acoustical reproduction may be made, for instance, by voice reproduction. This may make the use of mobile terminal 5 in a vehicle easier. If the navigational data signal was transmitted as a text message or a short message, then a voice output of this text message or short message may be implemented in mobile terminal 5 with the aid of a language synthesis component not shown in FIG. 1. However, such a text message or short message, which includes the route proposal, may also be displayed on the display device. Subsequently, the program branches to a program point 145.

At program point 145, first evaluation unit 35 tests whether, within a specified time, a new position of mobile terminal 5 has become available, either via location receiver 15 or by user input on input device 20, which differs from the previous position of mobile terminal 5. If this is the case, the program branches to a program step 150, otherwise the program is exited.

At program step 150, first evaluation unit 35 causes first transmitting unit 25 to transmit the new position of mobile terminal 5 with the aid of an appropriate location data signal from first send/receive antenna 70 to main station 1 via mobile radio network 85. This location data signal, having the new position of mobile terminal 5, is received by second send/receive antenna 75, and is passed to second evaluation unit 50 via second receiving unit 40. Subsequently, the program branches to a program point 155.

At program point 155, second evaluation unit 50 selects a new map section from the map material filed in memory 45, which includes the new position of mobile terminal 5, this new map section may in turn be able to be adapted in a corresponding manner to the size of the display device of mobile terminal 5. The new map section may, in this case, be selected by second evaluation unit 50 in such a manner that the new position of mobile terminal 5 lies in the middle or in a middle region of the selected new map section. However, as described before, it may also be provided that the new position of mobile terminal 5 lies in an edge region of the selected new map section.

Subsequently, second evaluation unit 50 compares the present map section, selected before the new map section selected for mobile terminal 5, with the selected new map section and generates image data in dependence upon differences between the two map sections. Subsequently the program branches to a program point 160.

At program point 160, second evaluation unit 50 causes second transmitting unit 55 to transmit the generated image data from second send/receive antenna 75 to mobile terminal 5 via the mobile radio network 85. The generated image data are then received by first send/receive antenna 70 and passed on via first transmitting unit 30 to first evaluation unit 35.

In this connection, as described before, the image data may be transmitted to mobile terminal 5 from main station 1 to mobile terminal 5 coded by a compression method The transmission of the image data from main station 1 to mobile terminal 5 may be performed, in this context, as described, for example, according to an image telephony standard, for instance, according to the ITU-T Standard H.32x, one of image compression methods H.261 and H.263 being applicable.

After program point 160 the program branches to a program point 165. At program point 165, first evaluation unit 35 updates the map section displayed up to now on the display device of reproduction device 10 in dependence upon the transmitted image data, and brings the map section thus brought up to date to the display device for display.

Subsequently, the program branches to a program point 170. At program point 170, first evaluation unit 35 tests whether a navigational application was activated by the user of mobile terminal 5 on input device 20 or is still running. If this is the case, the program branches to a program point 175, and otherwise the program branches back to program point 145. At program point 175, first evaluation unit 35 tests whether a destination has already been input on input device 20 for the navigational application and has been transmitted to main station 1. If this is the case, then the program branches back to program point 130, and the route computation is correspondingly updated with the aid of the new position and the destination that is already known. Otherwise the program branches back to program point 125, and the input of an appropriate destination is requested as described.

In case mobile terminal 5 reaches the specified destination during a running navigational application, that is, that second evaluation unit 50 determines the identity of the position of mobile terminal 5 and the destination, the navigational application is broken off, after corresponding information concerning this breaking-off has been transmitted from main station 1 to mobile terminal 5, and has there been reproduced on reproduction device 10. For a straight navigational application without transmission of map sections from main station 1 to mobile terminal 5, it may also be provided that the flow diagram as in FIG. 2 first applies after program point 120, and is run through without program points 150, 155, 160, 165, so that the program branches from program point 145, in the"yes" decision case, directly to program point 170. This alternative example embodiment may make sense, for instance, if mobile terminal 5 is connected to a computer, e.g. a laptop, via a data interface, navigational software having been stored in the computer memory using map material. A route proposal transmitted to mobile terminal 5 from main station 1 may then be passed on via the data interface to the connected computer. Using the navigational software, the computer then selects a map section from the map material which appertains to the route proposal, and brings the route proposal to display on a display device, for instance, a display of the computer together with the appropriate selected map section. In this manner, mobile terminal 5 may share the use of the computer's display device, which may thus also be regarded as an external portion of reproduction device 10.

For the updating of the map section brought for display on the display device of reproduction device 10 at a time when the position of mobile terminal 5 changes, two different embodiments are given as examples in the following.

Figure 3:
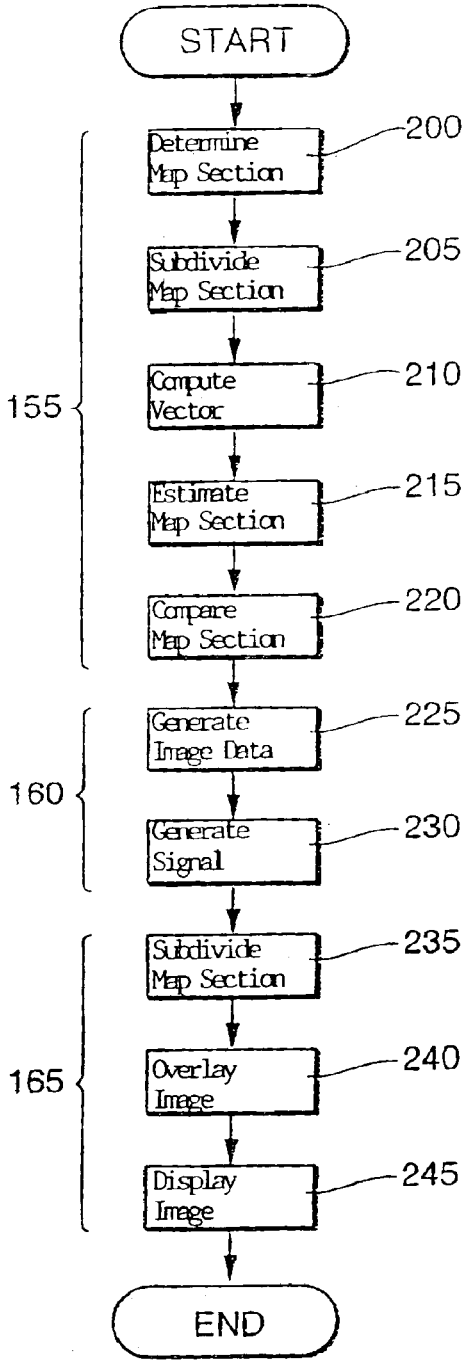
FIG. 3 is a flow diagram for describing a part of the general flow as in a first example embodiment.

FIG. 3 shows a flow plan for the sequence as in the first of the two example embodiments. In this context, this sequence relates to program points 155, 160 and 165 as in FIG. 2, which, in FIG. 2, are therefore shown each time as subroutines having double crosspieces. In this context, program point 155 is divided as follows for the first example embodiment:

At a program point 200, second evaluation unit 50 ascertains from the map material stored in memory 45 the new map section for the new position of mobile terminal 5, as described. Subsequently, the program branches to a program point 205.

At program point 205, second evaluation unit 50 subdivides the present map section, selected before the new map section for mobile terminal 5 into image blocks. Subsequently, the program branches to a program point 210.

At program point 210, second evaluation unit 50 computes a movement vector from the previous position to the new position for each of the image blocks, in dependence upon the position change of mobile terminal 5. Subsequently, the program branches to a program point 215.

At program point 215, second evaluation unit 50 estimates the new map section, starting from the present map section and the ascertained movement vectors. Subsequently, the program branches to a program point 220.

At program point 220, second evaluation unit 50 compares the estimated new map section with the new map section selected at program point 200, by difference formation. This may indicate that second evaluation unit 50 subtracts the new map section estimated at program point 215 from the new map section selected at program point 215, whereby a difference image is created. Subsequently, the program branches to a program point 225.

At program point 225, second evaluation unit 50 generates the corresponding image data which include the difference image generated at program point 220, and causes second transmitting unit 55 to transmit the image data along with the difference image with the aid of a corresponding image signal from second send/receive antenna 75 via mobile radio network 85 to mobile terminal 5. The image signal is received, in this case, by first send/receive antenna 70, and is passed on via first receiving unit 30 to first evaluation unit 35. Subsequently, the program branches to a program point 230.

At program point 230, second evaluation unit 50 generates a data signal which includes the movement vectors ascertained for the individual blocks of the present map section, and causes second transmitting unit 55 to transmit this data signal from second send/receive antenna 75 via mobile radio network to mobile terminal 5. This data signal is then received by first send/receive antenna 70 and fed to first evaluation unit 35 via first receiving unit 30. Subsequently, the program branches to a program point 235. Program points 225 and 230 as in FIG. 3, in combination, here form program point 160 as in FIG. 2.

At program point 235, first evaluation unit 35 subdivides the present map section into the same image blocks as was done by second evaluation unit 50 at program point 205, and shifts the image blocks thus formed, in each case with the aid of the appertaining movement vector ascertained by second evaluation unit 50 and transmitted to mobile terminal 5. By the shifting of the image blocks formed, using the movement vectors, a shifted map section results. Subsequently, the program branches to a program point 240.

At program point 240, first evaluation unit 35 overlays the shifted map section with the received difference image. The summed image formed in this manner is subsequently brought to display on the display device of reproduction device 10, at a program point 245, caused by first evaluation unit 35, and essentially corresponds to the new map section, assuming error-free ascertainment and transmission of the difference image and the movement vectors from main station 1 to mobile terminal 5, which was ascertained at program point 200 by second evaluation unit 50. However, instead of the transmission of the entire new map section, only the transmission of the difference image and the movement vectors is required, so that bandwidth and time would be saved in this transmission, as compared to the transmission of the entire new map section. The program is subsequently exited. Program points 235, 240 and 245, as in FIG. 3, in combination here form program point 165 as in FIG. 2.

The example method described as in FIG. 3 may also be the one on which image compression methods H.261 and H.262 according to ITU-T Standard H.32x are based.

In the case of successive transmission of difference images and the appertaining movement vectors, on account of transmitting errors, an accumulation of errors may occur, which eventually corrupts the map section to be displayed on the display device of reproduction device 10, and, under certain circumstances, may lead to considerable deviations from the original map material. In order to avoid this, it may be provided that transmission and display of the new map section be performed at specific times, e.g. at regular intervals, in exactly the same manner as for the very first map section according to program points 100, 105, 110 and 115 By such a so-called"image refresh", the display on the display device of mobile terminal 5 is adjusted again and again to the original map material as stored in memory 45.

Of course, the position of mobile terminal 5, on which this map section is based, is faded into each new map section displayed on the display device of mobile terminal 5. In this context, the position is already faded into the difference image by second evaluation unit 50, so that the difference image is transmitted along with the faded-in position from main station 1 to mobile terminal 5.

Figure 4:
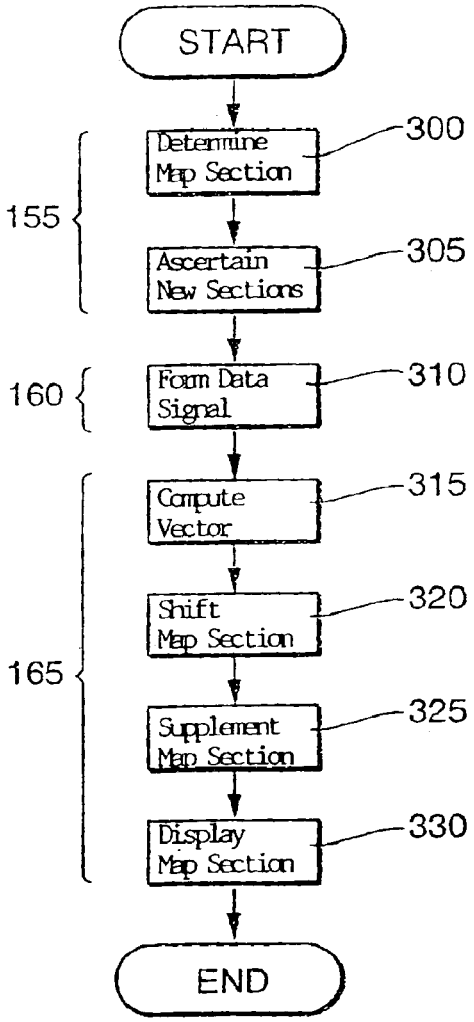
FIG. 4 is a flow diagram for describing a part of the general flow as in a second example embodiment.

A second example embodiment for updating the map section to be displayed on the display device is shown with the aid of a flow diagram as in FIG. 4. Here, program point 155 as in FIG. 2 is subdivided into a program point 300 and a program point 305. At program point 300, second evaluation unit 50 ascertains the new map section based on the new position of mobile terminal 5, from the map material stored in memory 45 as described. The program subsequently branches back to program point 305.

At program point 305, second evaluation unit 50, by comparison of the new map section with the present map section, ascertains those map sections which are included only in the new map section, and not in the present map section. Subsequently, the program branches to a program point 310.

At program point 310, second evaluation unit 50 forms a data signal having image data which include the map regions ascertained at program point 305 and causes second transmitting unit 55 to transmit this image signal from second send/receive antenna 75 via mobile radio network 85 to mobile terminal 5. This image signal is received by first send/receive antenna 70 and fed to first evaluation unit 35 via first receiving unit 30. Subsequently, the program branches to a program point 315. The processes described at program point 310 according to FIG. 4 thus run as in program point 160 of FIG. 2.

At program point 315, first evaluation unit 35 computes an overall movement vector from the change in position of mobile terminal 5 from the previous position to the new position. Subsequently, the program branches to a program point 320.

At program point 320, first evaluation unit 35 shifts the map section displayed on the display device by the amount of the overall movement vector ascertained at program point 315, and fades in the position of mobile terminal 5 at the same location on the display device as for the present map section shown. On account of the shifting of the present map section by the amount of the overall movement vector, it may happen that individual map regions of the map section presently displayed get to lie outside the displayable range of the display device, and thus may no longer be displayed. On the other hand, on account of the shifting of the map section, empty spaces are created at another location in the displayable range of the display device, at which no map data may be displayed any longer. On account of the shifting of the presently displayed map section by the overall movement vector, the faded-in position of mobile terminal 5 remains the same at the display device. After program point 320, the program branches to a program point 325.

At program point 325, first evaluation unit 35 supplements the present map section shifted by the overall movement vector by the transmitted map sections at those locations at which there would otherwise be no display of map data on the display device. In this fashion, on the display device of mobile terminal 5, the result is a display of the new map section selected at program point 300, which is brought to display on the display device of reproduction device 10 in program point 330. Thus, program points 315, 320, 325 and 330 as in FIG. 4 form program point 165 as in FIG. 2. Subsequently, the program is exited.

The example method described as in FIG. 4 may have desirable features as compared to the example method described with respect to FIG. 3:

1. No effortful computation of a difference image in second evaluation unit 50 may occur, but only the ascertainment of the supplementing map regions.
2. No movement vectors may have to be transmitted from main station 1 to mobile terminal 5. Since the entire present map section is uniformly shifted in dependence upon the position change of mobile terminal 5, ascertainment of the overall movement vector may be sufficient, so that no block-wise subdivision of the present map section and ascertainment of the appertaining movement vector are required.
3. An "image refresh" may not be required, since with the supplementing map regions, parts of the original map material are transmitted in any case from main station 1 to mobile terminal 5.

Even if the subdivision of the present map section provided for the moved-image transmission, according to one current image compression method, and the allocation, in each case, of a movement vector to the individual image blocks, according to the method as in FIG. 4, may not be required on account of the uniform shifting of the map section, one may still undertake a coding of these supplementing map regions according to a compression method as may be customary in the transmission of moved images, for example, according to ITU-T Standard H.32.x, with the aid of an image compression method such as H.261 and H.263, for transmission of the supplementing map regions, ascertained according to the method as in FIG. 4, from main station 1 to mobile terminal 5.

For the transmission of the image data from main station 1 to mobile terminal 5, in all the cases described, a video channel according to the H.323 Standard may be arranged from main station 1 to mobile terminal 5. To be sure, the image data may also be transmitted coded, according to any compression method, from main station 1 to mobile terminal 5.

If sufficient transmission bandwidth is available for transmitting image data from main station 1 to mobile terminal 5 via mobile radio network 85, according to a third example embodiment it may also be provided that each new map section shall be transmitted in its entirety from main station 1 to mobile terminal 5 and shall there be displayed on the display device. For this then, program points 100, 105, 110 and 115 as in FIG. 2 are successively run through, and if a navigational application is desired, after each newly ascertained position of mobile terminal 5, a new route to the input destination may be able to be performed according to program points 130, 135 and 140. If the user of mobile terminal 5 enters any position in input device 20, he may request the appertaining map section from main station 1, in the manner described. A new position may then occur, for example, by using so-called directional keys or arrow keys on input device 20, which each specify an overall movement vector of a definite length. In this manner, the map section displayed on the display device of mobile terminal 5 may be shifted by the user in any direction and be supplemented by new map regions corresponding to any one of the three described example embodiments.

The assumption for the display of map material on mobile terminal 5 is a sufficiently large display device. In this context, data concerning the size of the display device of mobile terminal 5 may be transmitted, as described, before the transmission of the first map section to main station 1 or to second evaluation unit 50. In general, mobile terminal 5 may transmit control data to main station 1 or second evaluation unit 50, before the first transmission of a map section, which may include data concerning the display capabilities and display possibilities of mobile terminal 5, which, besides the size of the display device, may also contain the resolution properties and statements concerning the color capability of the display device, or the like. However, it may also be provided to supply the statements on the capabilities of the display device of mobile terminal 5 to main station 1 from a central databank, in which pertinent data on several mobile terminals may be stored. The display device may be integrated into mobile terminal 5, may be capable of being plugged onto it, or may be connected to it by a cable connection or in a wireless manner.

In the case of the second example application described as in FIG. 4, the image data to be transmitted from main station 1 to mobile terminal 5 may optionally be compressed. In this connection, compression may be performed using an image compression method for moved image transmission, for instance, according to ITU-T Standard H.32x and one of image compression methods H.261 and H.263 used in this standard. On account of the static nature of the image data to be transmitted, which are based on geographical map material and thus include fixed images, a compression of the image data to be transmitted that is more efficient for this application may also be used, than what is required for the transmission of moved images. In this context, for instance, a so-called run length coding or a compression method adapted especially to the statistics of the map data may be used.

The example methods described in connection with the first and above all the second example embodiment may make possible in current mobile networks, for example, according to the GSM Standard (Global System for Mobile Communications) or the DCS 1800 Standard (Digital Communication System), even at a data rate of only 9.6 kbit/s, a position tracing of mobile terminal 5 in a map section that is current in each case, as described.

New mobile networks of the third generation, for example, according to the UMTS Standard (Universal Mobile Telecommunication System) or according to the GPRS Standard (General Packet Radio Service) may offer data rates up to 2 Mbit/s in the future. This may permit the genuine transmission of moved images and may offer an optimal prerequisite and thus an improved quality of navigational services such as, for example, the display of a virtual world. At data rates up to 2 Mbit/s, complete transmission of the map section, completely up to date in each case, from main station 1 to mobile terminal 5 according to the third example embodiment may be supported.

As to mobile terminal 5, this may be any mobile telecommunication terminal.

Accounting for the services used by terminal 5 for transmitting map section data and possibly route proposals may be done via the telephone bill. One or more successive telecommunication connections may be used, for transmitting the location-related data information between main station 1 and mobile terminal 5, which are based in each case on calling the appropriate call number of main station 1 or mobile terminal 5.

What is claimed is:

1. A method for transmitting location-related data information between a main station and a mobile terminal, comprising:

(i) ascertaining a position of the mobile terminal and transmitting the position, as well as information on a size of a map section reproducible on a reproduction device of the mobile terminal, from the mobile terminal to the main station;

(ii) forming location-related data information for the mobile terminal in the main station as a function of the ascertained position of the mobile terminal;

(iii) transmitting the location-related data information from the main station to the mobile terminal;

(iv) reproducing the received location-related data information on the reproduction device of the mobile terminal;

(v) ascertaining a new position of the mobile terminal and transmitting the new position to the main station;

(vi) selecting a new map section in the main station, the selected new map section including the new position of the mobile terminal;

(vii) transmitting image data from the main station to the mobile terminal as a function of differences between the selected new map section and a present map section; and (viii) updating the present map section dependent upon the transmitted image data and reproducing the updated map section on the reproduction device, wherein:

step (ii) further includes selecting a section of a geographical map in the main station, the selected map section including the ascertained position of the mobile terminal;

step (iii) further includes transmitting the selected map section from the main station to the mobile terminal;

step (iv) further includes reproducing the transmitted map section having the ascertained position on the reproduction device;

step (vi) further includes subdividing the present map section into individual image blocks, computing a movement vector for each of the image blocks in dependence upon a change in position from a previous position to the new position of the mobile terminal, estimating the new map section starting from the present map section and the movement vectors, and comparing the estimated map section to the new map section by difference formation, so that a difference image is created;

step (vii) further includes transmitting the difference image to the mobile terminal, and transmitting the movement vectors from the main station to the mobile terminal; and step (viii) further includes computing the map section to be reproduced on the reproduction device from the present map section, by shifting the present map section block-wise with an aid of the movement vectors and overlaying the shifted map section with the difference image.

2. The method according to claim 1, wherein the mobile terminal includes a mobile telecommunications terminal.

3. The method according to claim 1, wherein:

step (ii) further includes computing a route proposal in the main station between the ascertained position of the mobile terminal and a specified destination;

step (iii) further includes transmitting the route proposal from the main station to the mobile terminal; and step (iv) further includes reproducing the route proposal on the reproduction device.

4. The method according to claim 3, wherein step (i) further includes inputting a destination on the mobile terminal and transmitting the inputted destination to the main station.

5. The method according to claim 3, wherein the selected geographical map section is transmitted to the mobile terminal in a coded form by a compression method.

6. The method according to claim 5, wherein the compression method includes one of an H.261 image compression method and an H.263 image compression method according to International Telecommunication Union (ITU-T) Standard H.32x.

7. The method according to claim 1, wherein in step (ii), the geographical map section is selected so that the position of the mobile terminal ascertained in step (i) lies essentially in a middle region of the selected geographical map section.

8. The method according to claim 1, wherein in step (vi), the new map section is selected so that the new position of the mobile terminal ascertained in the step (v) lies essentially in a middle region of the selected new map section.

9. The method according to claim 7, further comprising:

using one of an H.261 image compression method and an H.263 image compression method according to International Telecommunication Union (ITU-T) Standard.

10. The method as recited in claim 7, wherein:

step (vii) further includes transmitting the new map section at specified times from the main station to the mobile terminal with the aid of the image data; and step (viii) further includes reproducing the new map section having the new position on the reproduction device.

11. The method according to claim 1, wherein the image data transmitted to the mobile terminal are coded by a compression method.

12. The method according to claim 11, wherein the compression method includes at least one of an H.261 image compression method and an H.263 image compression method according to International Telecommunications Union (ITU-T) Standard H.32x.

13. The method according to claim 1, wherein the position of the mobile terminal is ascertained by a position-finding receiver.

14. The method according to claim 13, wherein the position-finding receiver includes a Global Positioning System receiver.

15. The method according to claim 1, further comprising:

inputting the position of the mobile terminal into an input device of the mobile terminal.

16. A method for transmitting location-related data information between a main station and a mobile terminal, comprising:

(i) ascertaining a position of the mobile terminal and transmitting the position, as well as information on a size of a map section reproducible on a reproduction device of the mobile terminal, from the mobile terminal to the main station;

(ii) forming location-related data information for the mobile terminal in the main station as a function of the ascertained position of the mobile terminal;

(iii) transmitting the location-related data information from the main station to the mobile terminal;

(iv) reproducing the received location-related data information on the reproduction device of the mobile terminal;

(v) ascertaining a new position of the mobile terminal and transmitting the new position to the main station;

(vi) selecting a new map section in the main station, the selected new map section including the new position of the mobile terminal;

(vii) transmitting image data from the main station to the mobile terminal as a function of differences between the selected new map section and a present map section; and (viii) updating the present map section dependent upon the transmitted image data and reproducing the updated map section on the reproduction device;

wherein:

step (ii) further includes selecting a section of a geographical map in the main station, the selected map section including the ascertained position of the mobile terminal;

step (iii) further includes transmitting the selected map section from the main station to the mobile terminal;

step (iv) further includes reproducing the transmitted map section having the ascertained position on the reproduction device;

step (vi) further includes ascertaining map regions which are included only in the new map section and not in the present map section;

step (vii) further includes transmitting the ascertained map regions from the main station to the mobile terminal with the aid of the image data; and step (viii) further includes shifting a presently reproduced map section with an aid of an overall movement vector computed based on a position change of the previous position to the new position of the mobile terminal, and supplementing the shifted map section formed in this manner by the transmitted map sections.

17. A mobile terminal, comprising:

an evaluation unit for ascertaining a position of the mobile terminal;

a transmitting unit for transmitting the ascertained position to a main station;

a receiving unit for receiving location-related data information from the main station, the location-related data information being generated as a function of the ascertained position; and a reproduction device for reproducing the location-related data information, wherein the transmitting unit is configured to transmit to the main station information regarding a size of a map section reproducible on the reproduction device;

wherein the evaluation unit is configured to update a map section presently reproduced on the reproduction device, as a function of image data received from the main station after transmission of the ascertained position;

wherein the receiving unit, by use of the image data, receives a difference image between a new map section and an estimated new map section from the main station, and also receives movement vectors from the main station, the movement vector being allocated to individual blocks of a present map section; and wherein the evaluation unit is configured to compute the map section to be reproduced on the reproduction device from the present map section by shifting the present map section block-wise with the aid of the movement vectors and overlaying the shifted map section with the difference image.

18. The mobile terminal according to claim 17, wherein the mobile terminal includes a mobile telecommunications terminal.

19. The mobile terminal according to claim 17, wherein the location-related data information includes one of a section of a geographical map and a route proposal.

20. The mobile terminal according to claim 17, further comprising:

a location finding receiver for receiving location finding data for position ascertainment.

21. The mobile terminal according to claim 20, wherein the location finding receiver includes a Global Positioning System receiver.

22. The mobile terminal according to claim 17, further comprising:

an input device for receiving input for the position of the mobile terminal.

23. A mobile terminal, comprising:

an evaluation unit for ascertaining a position of the mobile terminal;

a transmitting unit for transmitting the ascertained position to a main station;

a receiving unit for receiving location-related data information from the main station, the location-related data information being generated as a function of the ascertained position; and a reproduction device for reproducing the location-related data information, wherein the transmitting unit is configured to transmit to the main station information regarding a size of a map section reproducible on the reproduction device;

wherein the evaluation unit is configured to update a map section presently reproduced on the reproduction device, as a function of image data received from the main station after transmission of the ascertained position;

wherein the receiving unit is configured to receive map sections from the main station with the aid of the image data; and wherein the evaluation unit is configured to compute the map section to be reproduced on the reproduction device from the presently reproduced map section by ascertaining an overall movement vector from a position change of a previous position to the a position of the mobile terminal, shifting the presently reproduced map section with the aid of the computed overall movement vector, and supplementing the shifted map section with the transmitted map sections.

24. A main station, comprising:

a receiving unit for receiving data regarding a position of a mobile terminal and a size of a map section reproducible on a reproduction device of the mobile terminal;

an evaluation unit for forming location-related data information as a function of the position of the mobile terminal, and for selecting the map section so that it is completely reproducible on the reproduction device;

a transmitting unit for transmitting the location-related data information to the mobile terminal;

a memory for storing geographical map material, wherein the evaluation unit is configured to select a map section from the memory which includes the position of the mobile terminal, the selected map section at least partially forming the location-related data information;

wherein the evaluation unit is configured to, upon receiving a new position of the mobile terminal by the receiving unit, select a new map section which includes the new position of the mobile terminal;

wherein the evaluation unit is configured to transmit image data via the transmitting unit to the mobile terminal, as a function of differences between the selected new map section and the present map section;

wherein the evaluation unit is configured to subdivide the present map section into individual image blocks, compute a movement vector for each of the image blocks as a function of a change in position from a previous position to the new position of the mobile terminal, estimate the new map section starting from the present map section and the movement vectors, and compare the estimated map section to the new map section by difference formation so that a difference image is created; and wherein the transmitting unit is configured to transmit the difference image to the mobile terminal with the aid of the image data, and transmit the movement vectors to the mobile terminal.

25. The main station according to claim 24, wherein the mobile terminal includes a mobile telecommunications device.

26. The main station according to claim 24, wherein the evaluation unit is configured to compute a route proposal from the position of the mobile terminal and an input destination received from the mobile terminal, the route proposal at least partially forming the location-related data information.

27. The main station according to claim 24, wherein:

the evaluation unit is configured to, during selection of the new map section, ascertain map regions which are included only in the new map section and not in the present map section; and the transmitting unit is configured to transmit the ascertained map regions to the mobile terminal with the aid of the image data.

28. A method for transmitting location-related information between a control center and a mobile telecommunications terminal, the method comprising:

determining a position of the mobile terminal and transmitting it to the control center;

forming location-related information for the mobile terminal in the control center as a function of the determined position of the mobile terminal;

transmitting the location-related data information from the control center to the mobile terminal; and reproducing received location-related date information on a reproduction device of the mobile terminal;

wherein in the determining of the position, information relating to a size of the reproduction device on which a map excerpt which is reproduce-able is transmitted from the mobile terminal to the control center.

29. A mobile telecommunications terminal, comprising:

an evaluation arrangement to determine a position of the mobile terminal;

a transmitter arrangement to transmit a determined position to a control center;

a receiver arrangement to receive from the control center location-related data information which is generated as a function of the determined position; and a reproduction arrangement to reproduce the location-related data information;

wherein the transmitter arrangement is operable to transmit to the control center information relating to a size of the reproduction arrangement on which a map excerpt can be reproduced.

30. A control center, comprising:

a receiver arrangement to receive information relating to a position of a mobile telecommunications terminal;

an evaluation arrangement to form location-related information as a function of the position of the mobile terminal; and a transmitter arrangement to transmit the location-related information to the mobile terminal;

wherein the receiver arrangement is operable to receive information relating to a size of the reproduction arrangement of the mobile terminal on which a map excerpt can be produced, and wherein the evaluation arrangement is operable to select the map excerpt so that it is completely reproduce-able in the reproduction arrangement of the mobile terminal.

* * * * *